US008650782B2

(12) United States Patent
Miles et al.

(10) Patent No.: US 8,650,782 B2
(45) Date of Patent: Feb. 18, 2014

(54) HIGHWAY SIGN ASSEMBLY AND METHODS OF POSITIONING SAME

(76) Inventors: Tim Richard Miles, Pittsboro, NC (US); Sharyn Bills Miles, Pittsboro, NC (US)

( * ) Notice: Subject to any disclaimer, the term of this patent is extended or adjusted under 35 U.S.C. 154(b) by 0 days.

(21) Appl. No.: 13/506,849

(22) Filed: May 21, 2012

(65) Prior Publication Data

US 2013/0305575 A1 Nov. 21, 2013

(51) Int. Cl.
*G09F 15/02* (2006.01)

(52) U.S. Cl.
USPC ..... 40/606.18; 40/612

(58) Field of Classification Search
USPC ..... 40/453, 602, 612, 624, 606.18, 479; 116/63 R; 404/9
See application file for complete search history.

(56) References Cited

U.S. PATENT DOCUMENTS

| | | | | |
|---|---|---|---|---|
| 2,581,762 | A * | 1/1952 | Hesse | 40/653 |
| 2,781,017 | A * | 2/1957 | Fuller et al. | 116/63 R |
| 3,102,352 | A * | 9/1963 | White | 40/607.11 |
| 4,123,181 | A | 10/1978 | Schueler et al. | |
| 4,221,498 | A | 9/1980 | Schueler et al. | |
| 4,249,832 | A * | 2/1981 | Schmanski | 404/6 |
| 5,181,695 | A * | 1/1993 | Arthur | 256/13.1 |
| 5,396,724 | A | 3/1995 | Dinsmore | |
| 5,953,841 | A * | 9/1999 | Sawyer | 40/479 |
| 6,505,994 | B1 | 1/2003 | Attar | |
| D589,565 | S * | 3/2009 | Maschino | D20/41 |
| 2002/0100408 | A1 * | 8/2002 | Fricano | 116/63 R |
| 2009/0113772 | A1 * | 5/2009 | Traupianski | 40/446 |

* cited by examiner

*Primary Examiner* — Joanne Silbermann

(57) ABSTRACT

Highway or railroad sign assemblies having partial view obstructing means on their edges, mounted at an inclined position between or above road lanes or railroad tracks wherein vehicles or trains are traveling in opposite directions, and adapted to warn drivers that are going in the wrong direction without confusing drivers going the right way, and methods for so positioning such sign assemblies.

20 Claims, 12 Drawing Sheets

HIGHWAY SIGN ASSEMBLY AND METHODS OF POSITIONING SAME

BACKGROUND OF THE INVENTION

The use of highway signs to warn "wrong way" drivers driving in one or more adjacent lanes wherein vehicles are moving in opposite directions is well known, so as to reduce the incident of serious and often fatal accidents. In order to achieve this objective, such signs have been positioned in a variety of different ways, with more or less success. In some cases, the drivers fail to see the signs as positioned, and in some cases the signs are positioned so as to be clearly seen by drivers going in the correct direction, startling them and causing them to panic and react inappropriately, sometimes in a dangerous manner. In the case of roads wherein there are multiple lanes moving in the same direction, for example, such signs positioned on the outside shoulders of the outer lanes are not seen by drivers going the wrong way in the inside lanes. This problem is aggravated by the tendency of drivers to look rightward to view signs, and to disregard signs to their left, which is where the "wrong way" signs would be positioned as they proceeded in the wrong direction. In order to remedy this problem, in some cases "wrong way" signs have been positioned in the roadway median between opposite moving lanes. This has led to the problem referred to above, namely that drivers going in the correct direction also clearly view such signs, and are startled, especially drivers new to that particular sign usage area. Also, drivers who see such "wrong way" signs often soon come to ignore them, so will likely continue to ignore them when they are, in fact, going in the wrong direction. There is thus a need in the art for sign assemblies which will remedy these problems, and also reduce the number of signs needed, and according the cost of placing such signs. This is true both in the case of multilane roads, and in the case of roads with only a single lane in each direction.

SUMMARY OF THE INVENTION

The present invention relates to sign assemblies primarily designed to be positioned at an inclined angle in or above roadway medians or between railroad tracks and having view obstructing means thereon, or adjacent to their lateral edges, which permit drivers going the wrong way on roads or in trains to clearly see such warning indicia as 'WRONG WAY', but which at least partially obstruct the view of such indicia by drivers going the correct way, so as not to confuse them. It also relates to methods of positioning such assemblies between such roads or railroad tracks. It has utility in the medians of multilane roads, in the medians of two lane roads and mounted on bridges or overpasses. It could also be used between walking paths or industrial paths, for example.

DETAILED DESCRIPTION

Figure 1:
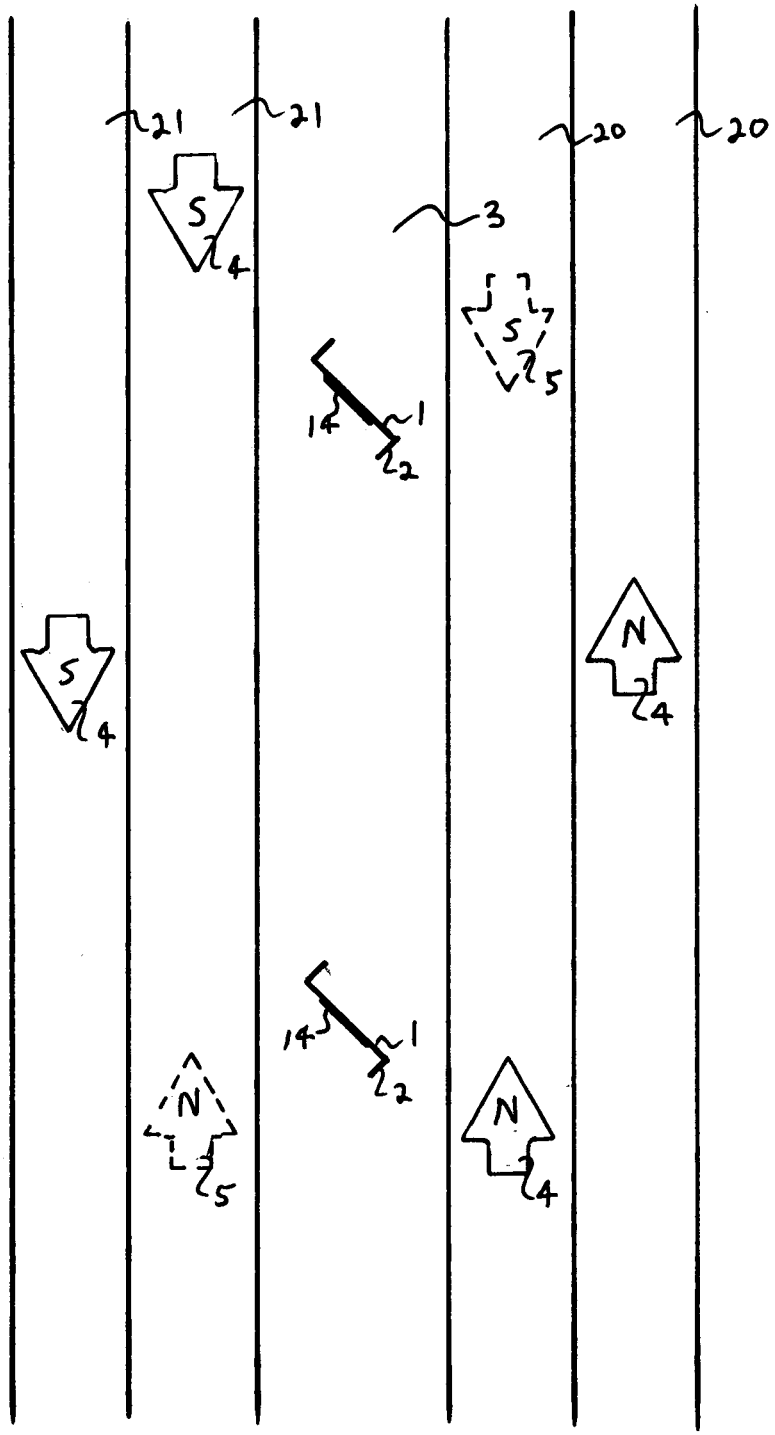
FIG. 1 is a plan view of a multilane roadway having a preferred embodiment of the invention installed in the median, wherein such indicia as "WRONG WAY" is used on both sides of the signs.

Illustrated in FIG. 1 is a plan view of a portion of a four lane road having a median 3, two north-bound lanes 20, two south-bound lanes 21, and an embodiment of the present invention mounted in the median comprising two 'WRONG WAY' signs 1, which may be of the same or similar construction, more particularly as shown in FIGS. 6-10, for example. These signs may display such indicia as "WRONG WAY" on both faces, and may be mounted by any of various mounting means 14, 15 or 18 as shown in various of FIGS. 6-10, for example. As also shown in all of these figures, the signs have partial view obstructing means 2 projecting from their vertical edges, or adjacent such edges, and have faces which are inclined relative to the direction of travel of the vehicles in lanes 20 and 21. Partial view obstructing means 2 would of course at least partially obstruct view of the indicia from positions generally forward of and lateral relative to the faces of the signs. The correct direction of travel in all of the lanes is indicated by solid arrows 4, and an incorrect direction of travel is indicated by dashed arrows 5.

It will be seen that the view of the indicia by drivers going the correct direction in all of the lanes will be partially obstructed by view obstruction means 2, especially as they approach and pass the signs. However, the view of the indicia by any drivers going the incorrect way in any of the lanes will be unobstructed, so that they will have a clear view of indicia, such as "WRONG WAY." Consequently, drivers going in correct directions will immediately recognize that the signs are not applicable to them, and drivers going in incorrect directions will immediately recognize their error. Drivers going the wrong way will, in fact, observe indicia such as "WRONG WAY" at an optimum angle of 90 degrees.

It may be noted that signs 1 will be located to the right of any drivers going in incorrect directions 5, which is especially desirable, because drivers are accustomed to looking to their right for controlling signs. Lanes 20 and 21 are labeled as running in north-south directions merely to facilitate understanding of the invention. Of course, the invention would be equally useful when used between lanes running in any two opposite directions, such as east-west.

Such variables as the most useful angle of inclination of the signs relative to the direction of travel of the vehicles, the size of the signs, the height of their mounting, the height or angle of obstructing means 2 on their edges, or the size and wording of the indicia, are subject to variation, based on experience. The most useful angles of inclination between the direction of travel and the faces of the signs may be in the range of substantially 120 to 135 degrees. The most useful angle of the obstructing means 2 relative to the faces of the signs may be in the range of 90 degrees. But those angles are obviously subject to variation depending on experience or particular usage. View obstructing means 2 would at least partially obstruct view of the indicia from positions located generally forward of and lateral relative to the face of the sign by drivers going the correct way, as noted above. Such positions could, for example, be in the range of substantially 140 to 160 degrees relative to the face or faces of the sign.

It is presently believed that the most useful height at which to mount the signs would be at a moderate height relative to ground or grade level, such as approximately at or a little above the average eye-level height of vehicle drivers passing the signs.

The indicia could be made from a reflective material, so as to be more clearly visible at night, or could be illuminated by solar-powered means.

Figure 2:
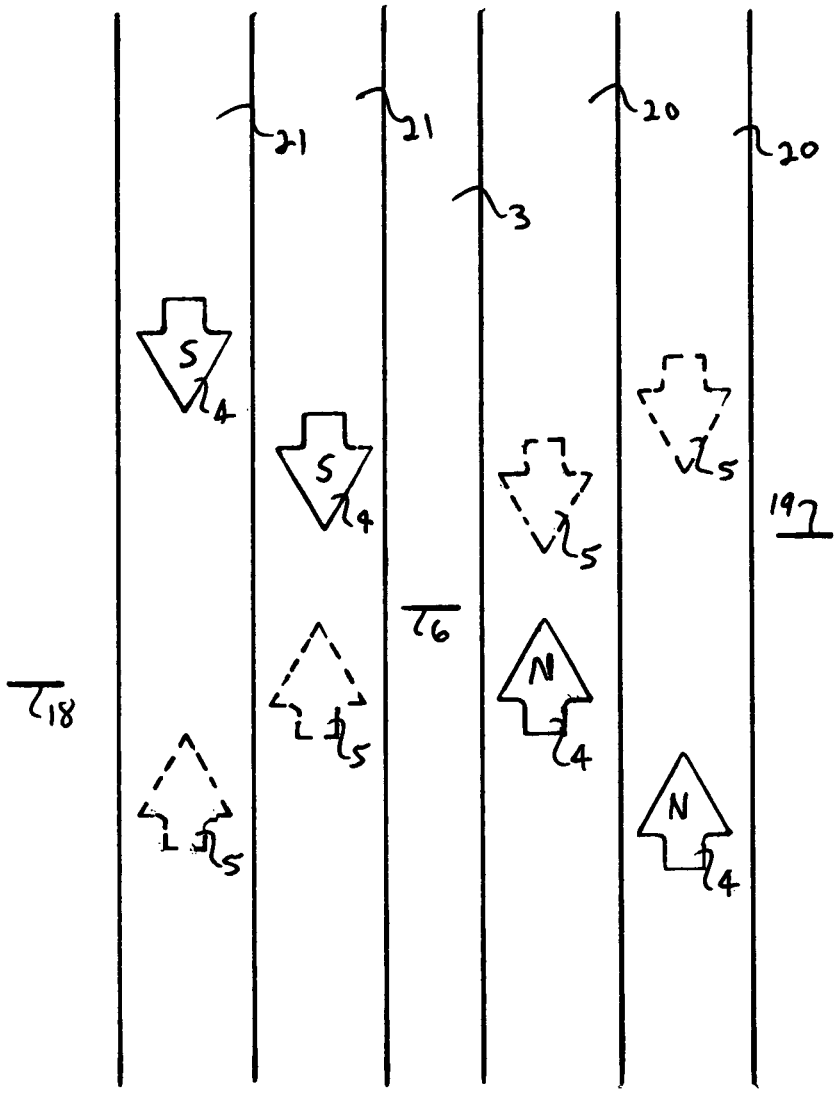
PRIOR ART FIG. 2
FIG. 2 is a plan view of one existing prior art arrangement of "WRONG WAY" signs on a multilane road.

FIG. 2 shows a portion of a prior art four lane road comparable to the four lane road of FIG. 1. As is the case in FIG. 1, there are two northbound lanes 20 and two southbound lanes 21. Mounted at 18 is a sign with "WRONG WAY" displayed on only the south-facing face, and intended to warn drivers going in the wrong direction in either of lanes 21 of their error. Mounted at 19 is a sign with 'WRONG WAY' displayed on only the north-facing face, and intended to warn drivers going the wrong way in either of lanes 20 of their error. Mounted in median 3 at 6 is a sign having "WRONG WAY" displayed on both faces, and intended to warn drivers going in the wrong direction in any of lanes 20 or 21 of their error. It will be seen that the faces of all of signs 6, 18 or 19 are positioned at 90 degrees relative to the direction of vehicle travel. Sign 6 is seen to be needed, in addition to signs 18 and 19, because drivers going the wrong way might not see either of signs 18 or 19, especially because these signs would be located to the left of such wrong-way drivers, where they would not expect to see signs controlling their movement. However, use of this sign arrangement causes drivers going in the correct direction in any of lanes 20 and 21 to get a full and very confusing view of the 'WRONG WAY' indicia on sign 6. This might well startle drivers going in a correct direction, and cause them to panic and react in a dangerous manner. In addition, drivers frequently passing this prior art sign arrangement soon become accustomed to seeing 'WRONG WAY' signs, such as sign 6, in full and close view, and consequently could be expected to just continue to ignore such signs if they were, in fact, going in the wrong direction.

The FIG. 1 embodiment of our invention eliminates all of these problems caused by confusing sign 6, and results in an arrangement by which wrong-way drivers are more likely to realize and correct their error. Although two signs 1 are shown close together in FIG. 1 for purposes of illustration, only one such sign would be needed on a particular extended portion of a road, or roads. In other words, signs 1 could be spaced far apart on roads. One might be placed near to where any access roads presented locations where drivers could enter in the wrong direction. Signs such as signs 18 and 19 could continue to be used, of course, or could be eliminated as unnecessary to reduce expense, all of signs 6, 18 and 19 being replaced by a single sign 1.

Figure 3:
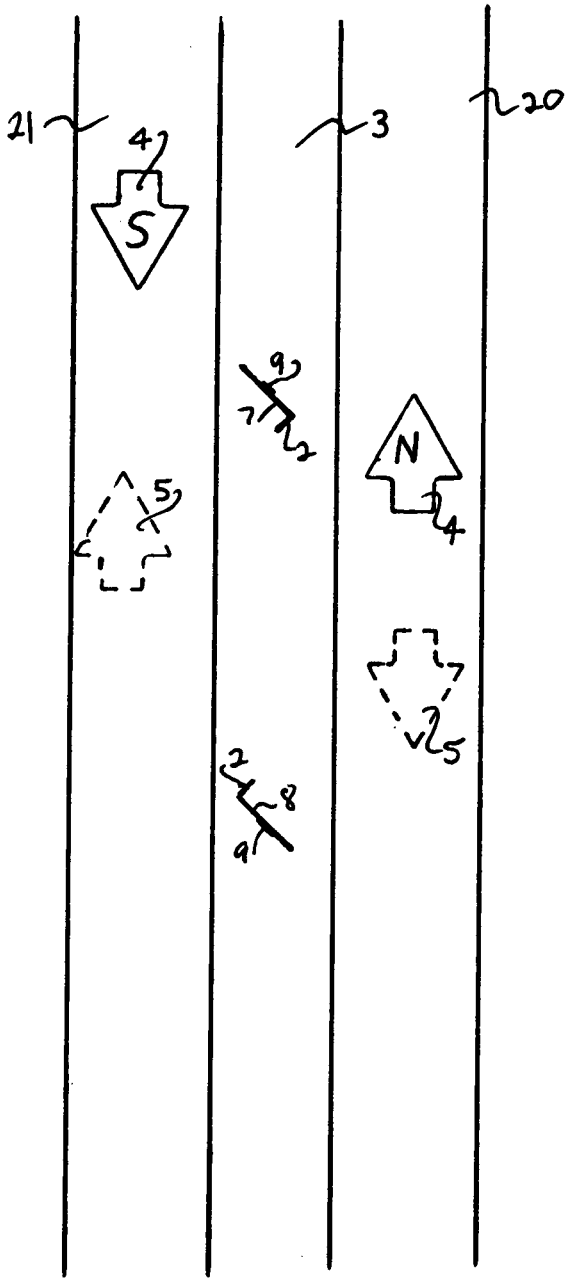
FIG. 3 is a plan view of a modified type of sign assembly wherein such indicia as "WRONG WAY" is used on only one side of each sign, on opposite sides of the two signs shown.

FIG. 3 shows another embodiment of our invention wherein signs 7 and 8 are used to warn drivers going the wrong way. In this embodiment, sign 8 has 'WRONG WAY' displayed on only its north (or, more precisely, northeast) facing face, to warn drivers going the wrong way in lane 20 of their error, and sign 7 has "WRONG WAY" displayed on only its south (or, more precisely, southwest) facing face, to warn drivers going the wrong way in lane 21 of their error. It will be apparent that this embodiment of our invention differs from our FIG. 1 embodiment in that signs 7 and 8, unlike sign 1 as used in FIG. 1, have 'WRONG WAY' displayed on only one face, and have view obstructing means 2 projecting from only one such face. Drivers going the correct way in lane 20 would not be able to see "WRONG WAY" on the north face of sign 8, since it would appear on only the side of sign 8 that faced away from them as they approached sign 8. Likewise, drivers going the correct way in lane 21 would not be able to see "WRONG WAY" on the south face of sign 7, since it would appear on only the side of sign 7 that faced away from them as they approached sign 7. Drivers going the correct way in lane 20 would have their view of "WRONG WAY" on the south face of sign 7 partially obstructed by view obstructing means 2 on sign 7. Drivers going the correct way in lane 21 would have their view of "WRONG WAY" on the north face of sign 8 partially obstructed by view obstructing means 2 on sign 8. It may be seen that signs 7 and 8 do, in fact, have exactly the same construction, although they are mounted in rotated positions relative to each other. Because they would be so rotated relative to each other when mounted, they have been given different reference numerals, even though they would be of the same construction. Signs 7 and 8 could be mounted relatively close together, as shown in FIG. 3, or spaced far apart. They could also be used to control multi-lane roads, as shown in FIGS. 1 and 2, as well as to control two lane roads, as shown in FIG. 3. Additional signs such as signs 18 and 19 could continue to be used, or they could be omitted, as desired.

Figure 4:
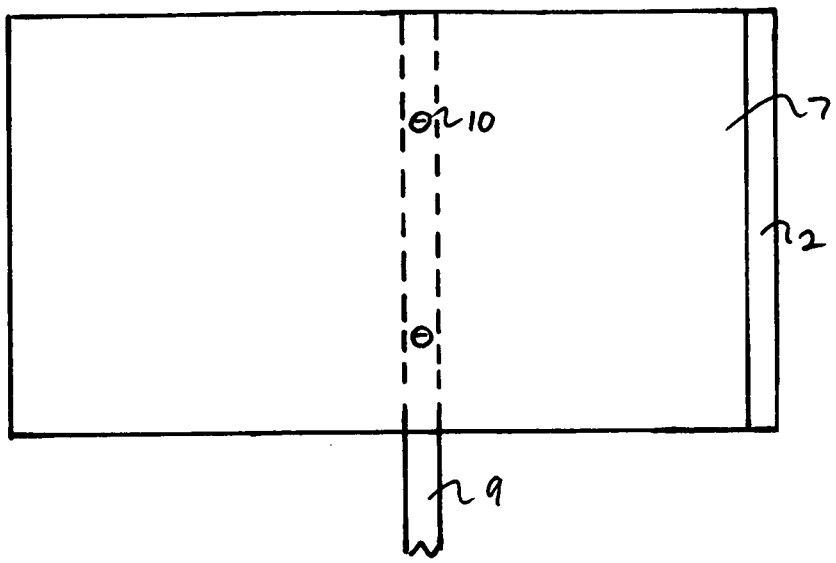
FIG. 4 is an elevation view of the type of sign used in FIG. 3.
Figure 5:
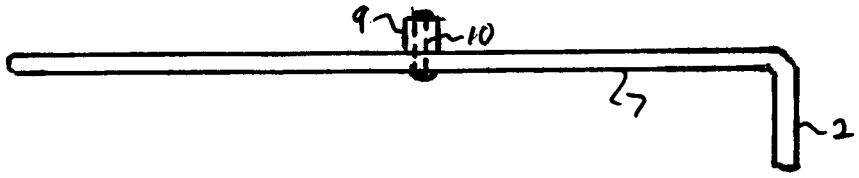
FIG. 5 is a plan view of the type of sign used in FIG. 3.

FIGS. 4 and 5 show elevation and plan views, respectively, of a sign 7 that is secured to a mounting channel 9 by bolts 10. Channel 9 would extend up from the ground or road grade and hold sign 7 at a moderate elevation, which could be at eye level or, for example, somewhat above eye level.

Figure 6:
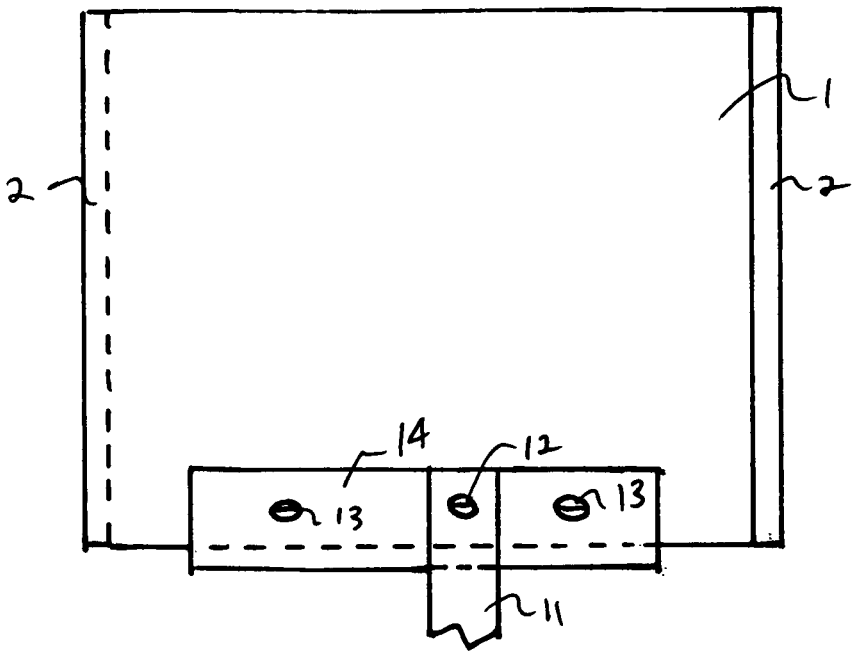
FIG. 6 is an elevation view of the type of sign shown in FIG. 1.
Figure 7:
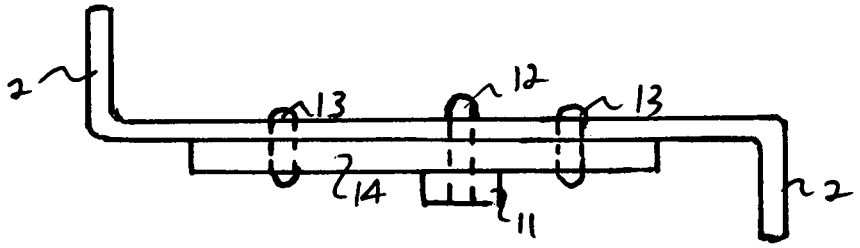
FIG. 7 is a plan view of the type of sign used in FIG. 1.

FIGS. 6 and 7 show elevation and plan views, respectively, of a sign 1 as shown in the FIG. 1 embodiment, being mounted by bolts 13 to a cross piece 14, which in turn is mounted to a support 11 by bolt 12.

Figure 8:
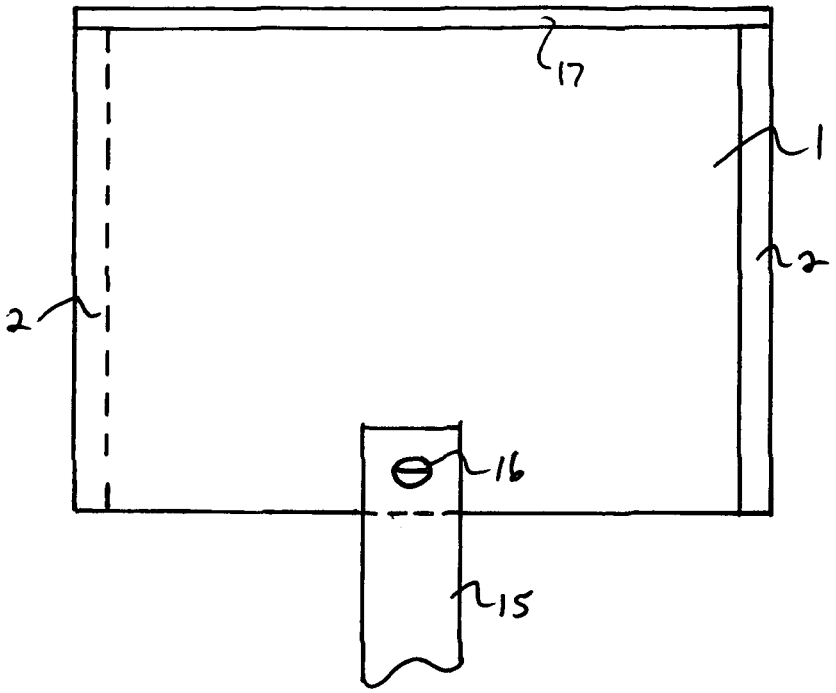
FIG. 8 is an elevation of the type of sign used in FIG. 1, with a modified mounting means comprising a pole, and utilizing a top support bar.
Figure 9:
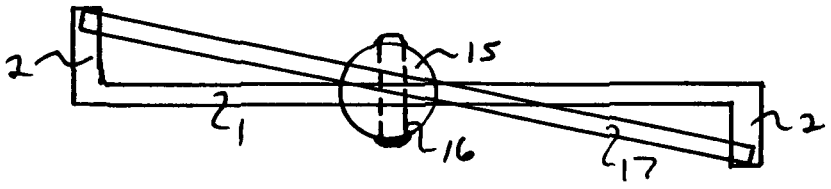
FIG. 9 is a plan view of the sign of FIG. 8.

FIGS. 8 and 9 show elevation and plan views, respectively, of a sign as shown in the FIG. 1 embodiment, having alternate mounting means comprising a slotted cylindrical post 15, and having an optional strengthening bar 17 secured to the top of the sign, to make it more wind resistant and stronger. Strengthening plates could be used in lieu of bar 17, of course, as well as at the bottom of sign 1.

Figure 10:
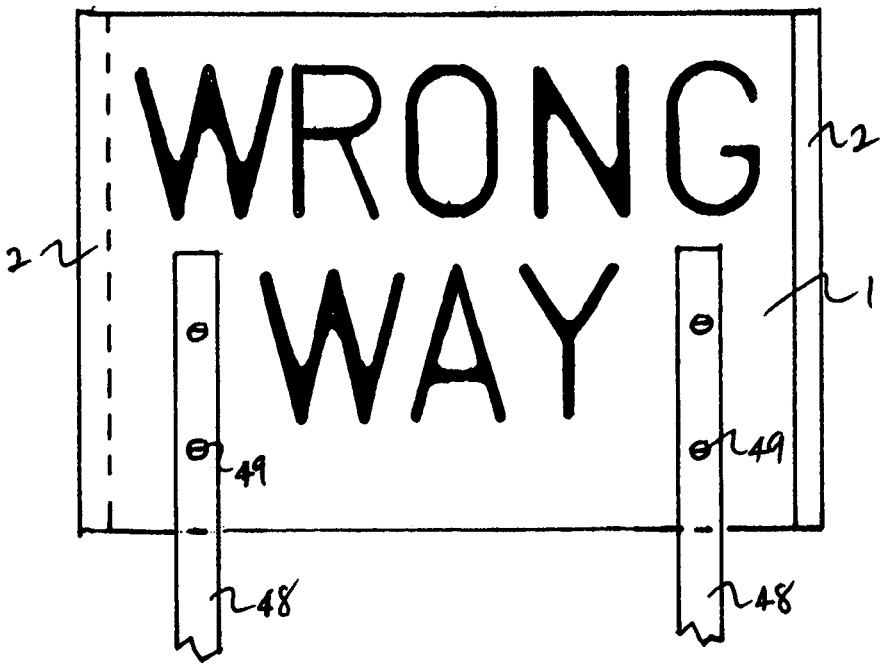
FIG. 10 is an elevation of the type of sign used in FIG. 1, but utilizing modified mounting means comprising dual support elements.

FIG. 10 shows an elevation view of the FIG. 1 type of sign, wherein it is mounted by bolts 19 to two channel or post members 18.

Figure 11:
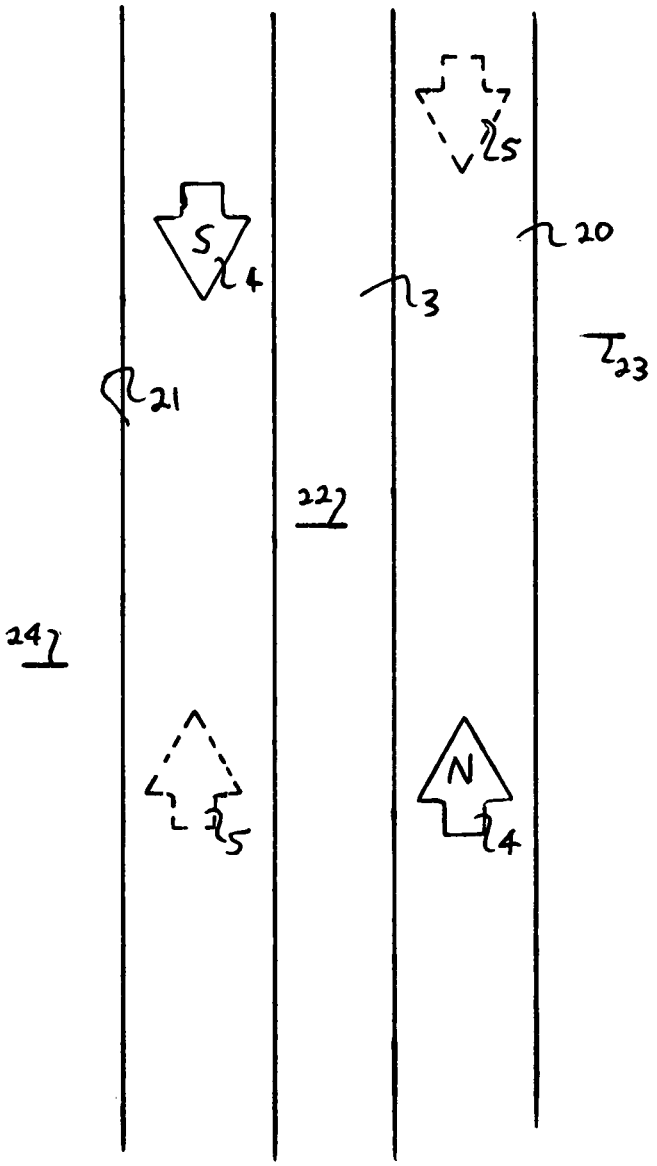
PRIOR ART FIG. 11
FIG. 11 is a plan view of a prior art "wrong way" sign arrangement used on a two lane road.

FIG. 11 is a plan view of a prior art arrangement similar to the prior art arrangement of FIG. 2, except with signs intended to control two lanes, instead of four lanes. Signs 22, 23 and 24 would be constructed in the same manner as signs 6, 19 and 18, respectively. And since sign 22 would have 'WRONG WAY' on both sides, as does sign 6, it would also cause the same problems.

Figure 12:
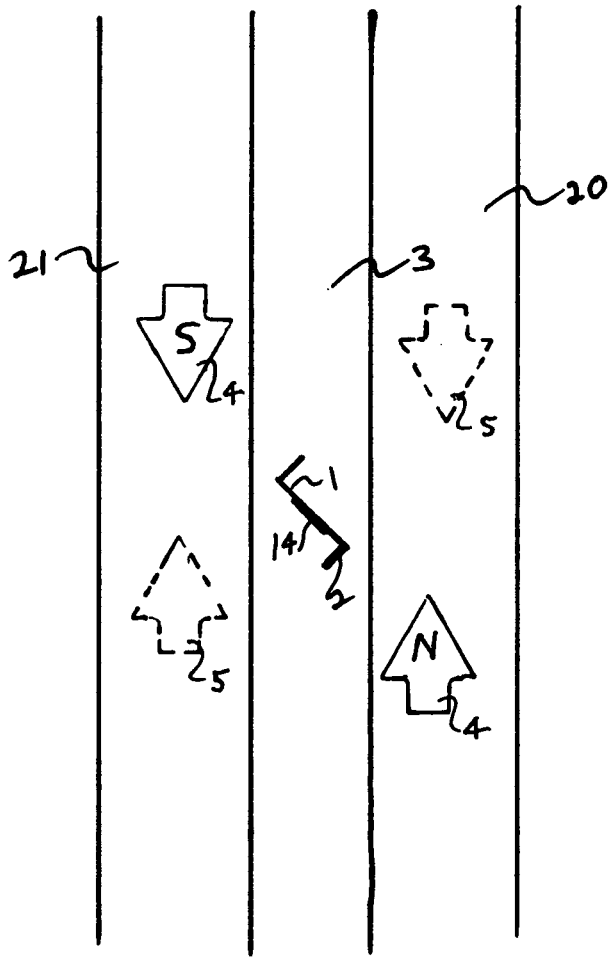
FIG. 12 is a plan view of an arrangement wherein the FIG. 1 type of sign is used in the median of a two lane road.

FIG. 12 is a plan view using a sign as shown in our FIG. 1 embodiment, having "WRONG WAY" on both faces, mounted in median 3, for warning drivers going in the wrong direction in either of lanes 20 or 21. This would be an improvement on the prior art arrangement of FIG. 11 in that all of signs 22, 23 and 24 could be omitted, eliminating the confusion caused by sign 22, and reducing costs, since three signs could be replaced by a single sign 1. In addition, it will be seen that even if sign 22 was omitted in the FIG. 11 prior art arrangement—that is, if only signs 23 and 24 were used—these two signs could be replaced by a single sign 1. In fact, sign 1 would be more likely to be seen because it would be to the right of drivers going the wrong way, unlike signs 23 and 24.

Figure 13:
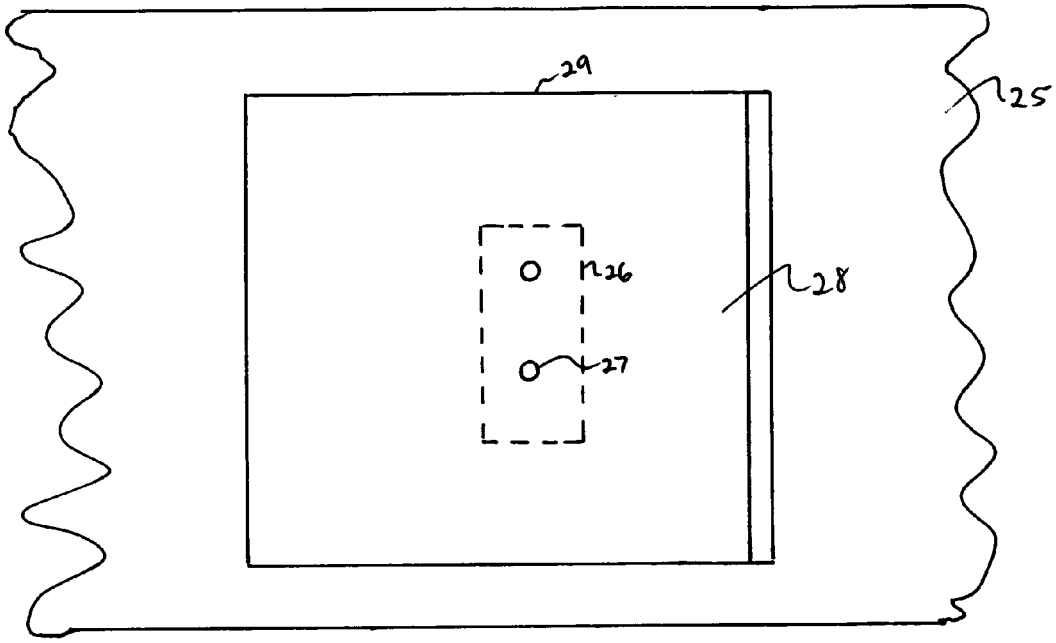
FIG. 13 is an elevation of a sign assembly mounted on the vertical face of a bridge or overpass.
Figure 14:
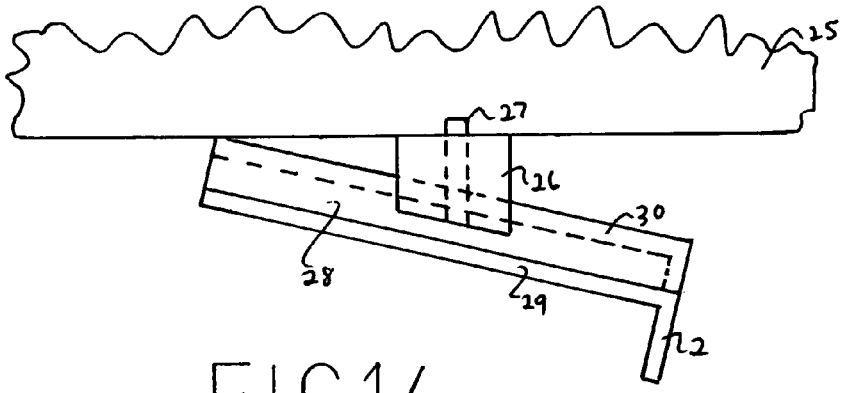
FIG. 14 is a plan view of the sign assembly shown in FIG. 13.

FIGS. 13 and 14 are elevation and plan views, respectively, of a 'WRONG WAY' sign 28 mounted on an overhead bridge or overpass 25 by means of a mounting element 26 secured to the bridge or overpass 25 and to sign 28 by bolts 27. Sign 28 would be inclined to the direction of vehicle travel on the road or roads below, as in our previous embodiments, and might also be inclined in a downward direction in order to facilitate its viewing by a driver on the road below, as shown. As in the previous embodiments, view obstructing means 2 would at least partially obstruct the view of "WRONG WAY" by a driver going the correct way in a lane to the right side of sign 28, but would permit a clear view of same by a driver going the wrong way in a lane below or to the left of sign 28. Of course, many different types of mounting means could be used in lieu of mounting means 26 and 27.

Figure 15:
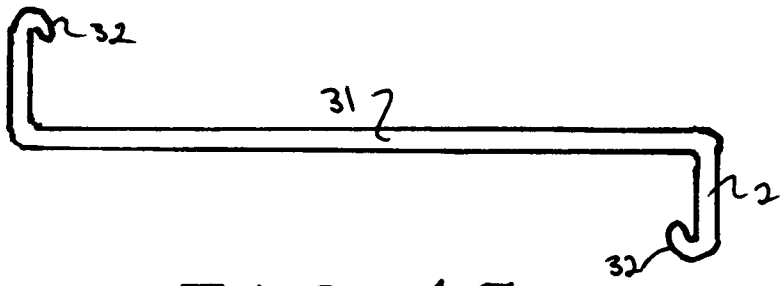
FIG. 15 is a plan view of a sign having ends of the projecting means bent backwards to form smooth edges.

FIG. 15 is a plan view of our FIG. 1 type of sign constructed of a relatively thin sheet of material 31 bent back upon itself at the outer edges of view obstructing means 2 to form a stronger and perhaps more visually appealing sign. Of course, this could also be done in the embodiment of FIGS. 4 and 5.

Figure 16:
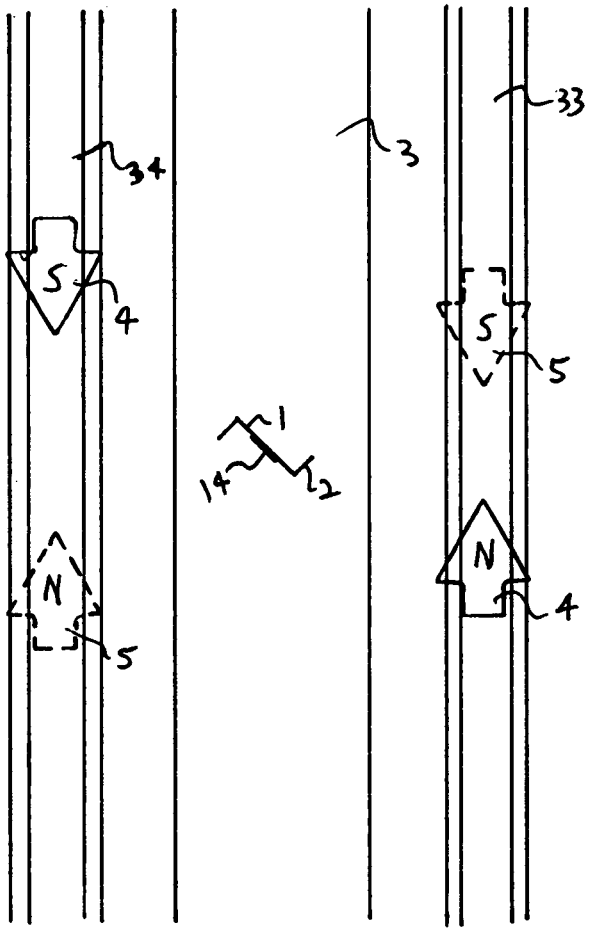
FIG. 16 is a plan view of our invention positioned between railroad tracks.

FIG. 16 is a view of our invention wherein a sign 1 as described above is positioned between northbound railroad tracks 33 and southbound tracks 34.

Although various embodiments of our invention have been described by way of example, it will be apparent to those skilled in the field that modifications may be made to such embodiments without departing from the scope of the invention.

We claim:

1. A highway or railroad sign assembly having structural means forming a single substantially planar face extending between lateral edges of the sign assembly and carrying integral informational indicia, means to support such assembly in a fixed, non-rotatable position wherein such face is located in an upright position at a moderate elevation relative to ground level, and means projecting forward from or located adjacent to a lateral edge of said face and extending outwardly from said face at an angle of approximately 90 degrees, and adapted to partially obstruct view of said indicia from positions generally forward of and lateral to the face of the sign, wherein the sign assembly includes no means forming an additional planar face laterally of said substantially planar face.

2. The assembly as claimed in claim 1, wherein said support means comprises post means joined to said sign assembly and extending upwardly from a position at or adjacent ground or grade level.

3. The assembly as claimed in claim 2, wherein said support means is adapted to support the sign assembly at or adjacent the eye level of motorists in vehicles or occupants in trains traveling adjacent said sign assembly.

4. The assembly as claimed in claim 1, wherein the means forming said face comprises a relatively flat sheet of material, and wherein the indicia appears directly on the face of said flat sheet of material.

5. The assembly as claimed in claim 4, wherein the sheet of material is bent at one or more of its lateral edges to form said forward projecting means.

6. The assembly as claimed in claim 1, wherein there are two said single planar sign faces, one on each opposite side of the sign assembly, carrying informational indicia, and said projecting means extends substantially outwardly from a lateral edge of both faces.

7. A sign assembly having two faces on opposite sides carrying integral informational indicia, each face having a single substantially planar portion extending between lateral edges of the sign assembly, means projecting outwardly from or located adjacent to a lateral edge of both of such faces, said means being adapted to obstruct view of said indicia from predetermined positions located generally forward of and lateral relative to the faces of the signs, and support means for holding said sign assembly in a fixed, non-rotatable position, wherein the projecting means extends outwardly from at least one face of the sign at an angle of approximately 90 degrees, and wherein said means projecting outwardly terminates at a free edge.

8. A sign assembly as claimed in claim 7, and said support means being attached to said assembly and extending downwardly from a lower edge of said assembly and adapted to support said assembly at or adjacent the eye level of occupants in adjacent vehicles or trains.

9. The sign assembly as claimed in claim 7, wherein the projecting means comprises integral bent portions of a relatively flat sheet of material.

10. A method of positioning an informative sign assembly having a single, substantially planar face extending between lateral edges of the sign assembly and carrying indicia at a location adjacent to or above roads or railroads, including positioning such sign assembly between or above such roads or railroads so that said single, substantially planar face of the sign assembly is inclined at a fixed angle substantially different from 90 degrees relative to the direction of travel on said roads or railroads, said face having means projecting from or located adjacent to one or more lateral edges of said sign assembly, adapted to at least partially obstruct view of said indicia from positions located generally forward of and lateral relative to the face of the sign assembly, and wherein there are no means forming an additional planar sign face mounted adjacent said single, substantially planar face.

11. The method of claim 10, wherein the sign assembly has two faces, and both faces have means projecting there from on or adjacent to their lateral edges.

12. The method of claim 10, wherein the said single, substantially planar face is formed by a continuous element which extends between the lateral edges of the sign.

13. The method of claim 10, including positioning the sign assembly at or adjacent to the eye level of occupants viewing such sign assembly from positions in vehicles traveling on the roads or railroads, and said positions are located at angles in the range of substantially 140 to 160 degrees relative to the face of the sign assembly.

14. The method of claim 10, including positioning the sign assembly at angles in the range of substantially 120 to 135 degrees relative to the correct direction of travel of adjacent vehicles or trains.

15. The method of claim 10, including selecting the indicia to indicate to individuals traveling on the roads or railroads that they are traveling in an incorrect direction.

16. The method of claim 10, including selecting indicia displaying "WRONG WAY".

17. The method of claim 10, including positioning the sign assembly on a bridge or overpass above the roads or railroads.

18. The method of claim 17, wherein the sign assembly is positioned so that the partial view obstructing means partially obstructs the view of the indicia by individuals traveling in the correct direction.

19. A highway or railroad sign assembly having structural means forming a single substantially planar face extending between lateral edges of the sign assembly and carrying integral informational indicia, means to support said assembly in a fixed, non-rotatable position wherein such face is located in an upright position at a moderate elevation relative to ground level, and means projecting from or located adjacent to a lateral edge of said face and extending outwardly from said face at an angle of approximately 90 degrees, and adapted to partially obstruct view of said indicia from positions generally forward of and lateral to the face of the sign, and wherein said means projecting outwardly terminates at a free edge.

20. A method of positioning an informative sign assembly having a single substantially planar face extending between lateral edges of the sign assembly and carrying indicia at a location adjacent to or above roads or railroads, including positioning such sign assembly between or above such roads or railroads so that at least one face of the sign assembly is inclined at a fixed angle substantially different from 90 degrees relative to the direction of travel on said roads or railroads, said face having means projecting from or located adjacent to one or more lateral edges of said sign assembly, adapted to at least partially obstruct view of said indicia from positions located generally forward of and lateral relative to the face of the sign assembly, and including selecting projecting means which extend at approximately 90 degrees to the face or faces of the sign assembly.

* * * * *